United States Patent [19]

Larrabee et al.

[11] Patent Number: 4,859,143

[45] Date of Patent: Aug. 22, 1989

[54] STIFFENING RING FOR A STATOR ASSEMBLY OF AN AXIAL FLOW ROTARY MACHINE

[75] Inventors: John R. Larrabee, Portland; Arthur W. Lucas, West Hartford; Peter A. Faucher, Brooklyn, all of Conn.

[73] Assignee: United Technologies Corporation, Hartford, Conn.

[21] Appl. No.: 71,000

[22] Filed: Jul. 8, 1987

[51] Int. Cl.[4] ..... F01D 9/04

[52] U.S. Cl. ..... 415/142; 415/139; 415/185; 416/193 A; 403/30; 403/340

[58] Field of Search ..... 415/172 R, 172 A, 173 R, 415/134, 137, 138, 139, 142, 185, 208, 210, 216–218; 416/193 A; 244/53 R; 411/383; 403/28, 29, 30, 340, 341; 60/226.1, 39.31, 39.32

[56] References Cited

U.S. PATENT DOCUMENTS

| | | | |
|---|---|---|---|
| 466,883 | 1/1892 | Bachem | 403/340 |
| 2,654,566 | 10/1953 | Boyd et al. | 415/137 |
| 2,867,460 | 1/1959 | Johnson | 403/28 |
| 3,216,654 | 11/1965 | Kappus | 415/210 |
| 3,351,319 | 11/1967 | Frost | 415/217 |
| 3,969,805 | 7/1976 | Lievens et al. | 415/217 |
| 3,997,280 | 12/1976 | Germain | 415/217 |
| 4,014,627 | 3/1977 | Heurteux | 415/217 |
| 4,249,859 | 2/1981 | Benyi, Jr. et al. | 415/217 |
| 4,398,864 | 8/1983 | Camboulives et al. | 415/134 |

*Primary Examiner*—Robert E. Garrett
*Assistant Examiner*—John T. Kwon

[57] ABSTRACT

A stator assembly for a gas turbine engine having a support structure and a stiffening ring 46 extending about the support structure 34 is disclosed. Various construction details which increase the rigidity of the support structure and enable the stiffening ring to accept axial and radial loads are developed. In one embodiment the stiffening ring 46 is the seal ring 52 for a seal end 74. In one particular embodiment, the thermal expansion characteristic of the support structure is greater than the thermal expansion characteristic of the stiffening ring to insure that the stiffening ring is in tension under normal operative conditions of the engine.

14 Claims, 4 Drawing Sheets

FIG. 2
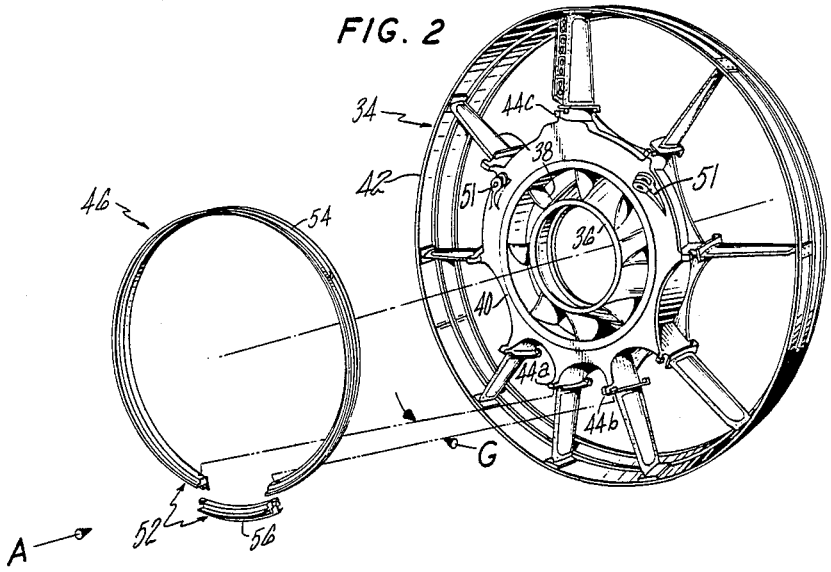
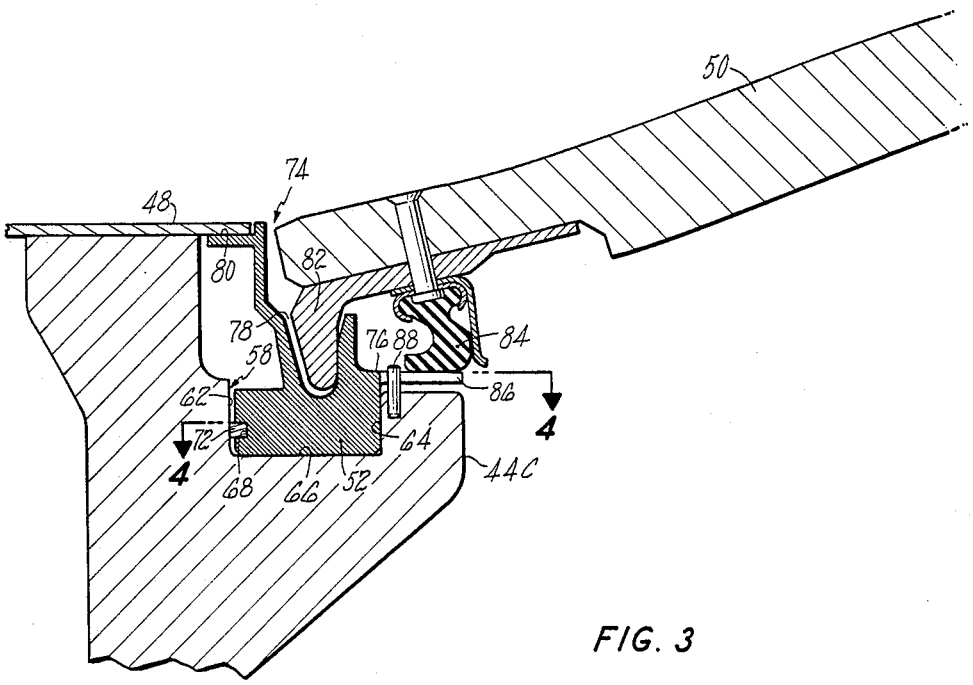
FIG. 3

FIG. 4
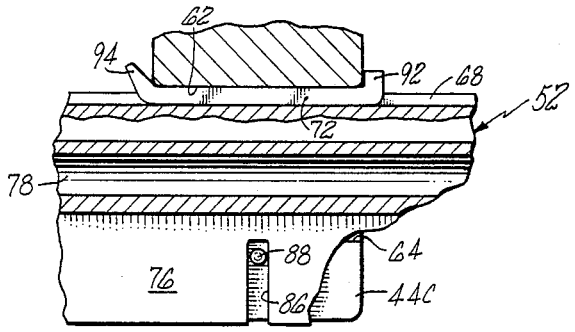
FIG. 5
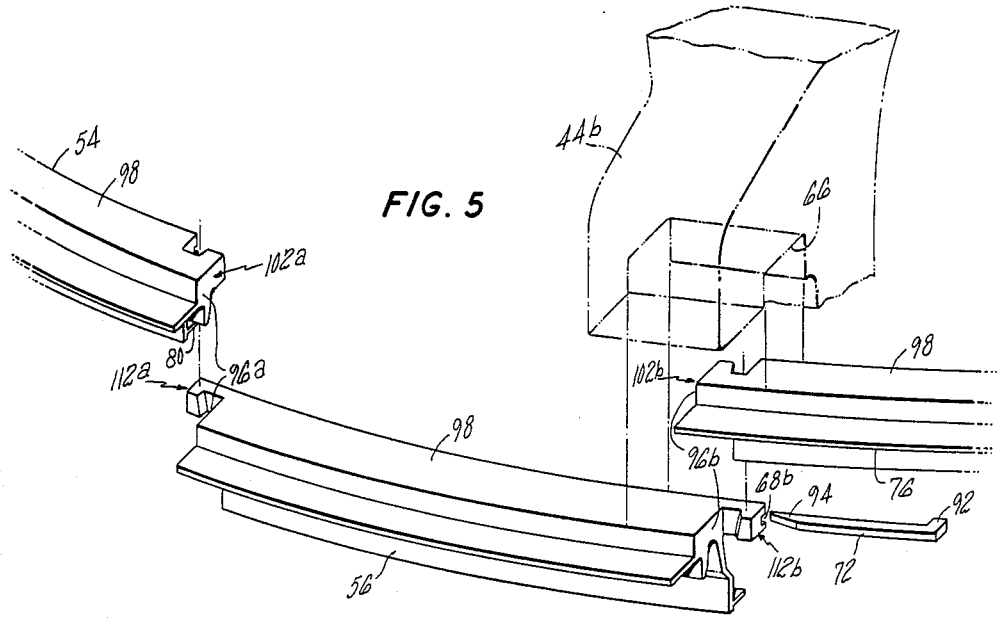
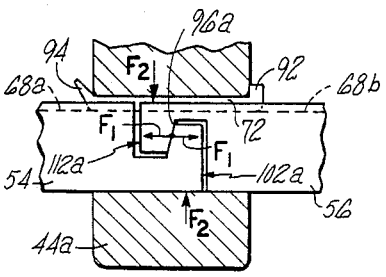
FIG. 6
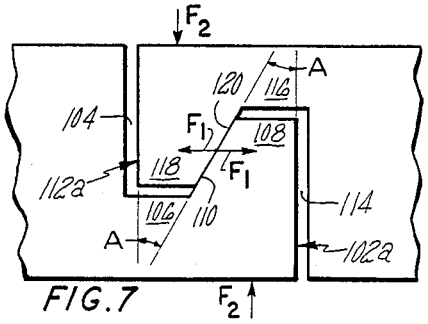
FIG. 7

STIFFENING RING FOR A STATOR ASSEMBLY OF AN AXIAL FLOW ROTARY MACHINE

TECHNICAL FIELD

This invention relates to a stator assembly for an axial flow rotary machnine and more particularly to a stiffening ring for the assembly. In one embodiment, the reinforcing ring has a seal land. Although this invention was developed in the field of axial flow gas turbine engines, it has application to other structures in the field of rotary machines.

BACKGROUND OF INVENTION

One example of an axial flow rotary machine is a turbofan gas turbine engine of the type used in aircraft. Such engines are mounted on the aircraft by a pylon or similar support structure. The engine and the nacelle which engages the pylon together form the powerplant for the aircraft. The nacelle circumscribes the turbofan engine to form an enclosed shelter for the engine, with the nacelle aiding the pylon in supporting the turbofan engine.

The turbofan engine powerplant has a compression section, a combustion section, and a turbine section. A primary flow path for working medium gases extends axially through the sections of the engine. The flow path is annular. An inner casing and an outer casing extend axially through the engine to bound the primary flow path. A secondary flow path for working medium gases extends axially through the engine and outwardly of the primary flow path. The secondary flow path is annular. The outer casing of the primary flow path inwardly bounds the secondary flow path. A second casing outwardly of the outer casing, outwardly bounds the secondary flowpath. The second casing is commonly called the fan casing. Radially extending struts extend between these casings to support and position the casings with respect to each other.

The nacelle has a nacelle inner body which extends axially to meet the outer casing and continues the inner boundary of the secondary flow path. The nacelle inner body has circumferentially extending doors which are hinged at the top of the nacelle and secured at the bottom to provide access to the engine through the nacelle. An example of such a construction is shown in U.S. Pat. No. 4,549,708 issued to Norris entitled *Cooling Latch System* which is assigned to the assignee of this application.

Because the nacelle is a structural element of the powerplant, the nacelle must transmit loads under operative conditions to the pylon which supports both the engine and the nacelle. These nacelle loads are transmitted in part directly from the nacelle to the pylon and transmitted inpart indirectly to the pylon through the engine. The engine has a radially extending stator structure which includes struts for receiving these nacelle loads and which provide a support for the engine. In addition, the interior of the nacelle is sealed to isolate the interior from the fan bypass duct. Accordingly, the nacelle engages the engine at a structure which can accept such loads while providing a seal at the interface.

In modern engines, the inner body of the nacelle typically engages a circumferentially extending ring. The ring provides a seal land which engages the circumferentially extending doors of the nacelle and is a structural member for transmitting part of the nacelle loads to the engine. This ring is held in place with fasteners such as bolts or rivets requiring holes which give rise to stress concentrations in the structure.

As a result, scientists and engineers working under the direction of Applicant's assignee have sought to construct a stator structure for receiving loads from the nacelle through a structure which accepts loads but which does not require that the structure be an integral part of a casing or require holes for fasteners that give rise to stress concentrations. In addition, it is important to provide the engine with a stiff stator structure while minimizing the impact that such structures have on the weight of the engine.

DISCLOSURE OF INVENTION

According to the present invention, a stator structure for a gas turbine engine includes a plurality of struts extending outwardly from an inner casing and a circumferentially extending ring in tension which engages the struts at a point intermediate to the struts to reinforce the stator structure.

In accordance with one embodiment, the circumferentially extending ring acts as a seal land to engage a circumferentially extending nacelle structure and is disposed in a groove under tension under all operative conditions of the engine.

A primary feature of the present invention is a stator assembly which includes an inner case and a plurality of outwardly extending struts. Each strut is adapted by a groove to receive a circumferentially extending ring. Another feature is the circumferentially extending ring which engages the struts and is under tension under operative conditions. The ring is trapped axially and radially in the groove which extends through each strut. In one embodiment, a feature is the absence of holes in the stator structure for bolts, rivets or like fasteners which avoids stress concentrations associated with such holes. In one detailed embodiment, the ring is segmented to permit removal of a segment from the ring. The joint between segments is disposed in the lug and a key is used to force engagement between the segments. The ring is adapted by hooks having inclined surfaces which increases the tension in the ring at assembly. The ring and support structure have different thermal expansion characteristics to increase the tension in the ring as the engine reaches its operative temperature.

A primary advantage of the present invention is the stiffness of the stator structure which results from the tensioned stiffening ring extending circumferentially about the structure. Another advantage is the size and weight of the stator structure for a given fatigue life which is associated with the absence of holes for fasteners in the stator structure. This results from using a boltless installation for the stiffening ring. In one embodiment, an advantage is the seal land provided by the stiffening ring which can accept axial and radial loads with decreased deflection in comparison to such rings which are not tensioned at installation. In one detailed embodiment, an advantage is the segmented construction of the seal ring which permits removal of the seal ring to provide replacement of portions of the seal ring or access to other structure in the engine. Another advantage is the shear strength of the segmented construction which results from disposing the joint of the segmented ring in a lug to cause the ring to resist shear loads with the transverse cross section of the ring. An advantage is the fatigue life at the joint which results from axial installation forces exerted by the key and lug on the ring that resist bending moments in each hook caused by tensile forces in the ring that act in the circumferential direction.

The foregoing features and advantages of the present invention will become more apparent in light of the following detailed description of the best mode for carrying out the invention and in the accompanying drawings.

BRIEF DESCRIPTION OF DRAWING

FIG. 2 is an exploded rear view of a stator assembly for the gas turbine engine shown in FIG. 1.

FIG. 3 is an enlarged cross-sectional view of a portion of the engine and nacelle showing a seal ring and a part of a nacelle inner body which is adjacent to the flow path and engages the seal ring.

FIG. 4 is a view taken along the lines 4—4 of FIG. 3.

FIG. 5 is an exploded view of the seal ring showing two segments of the ring and an associated lug in phantom at one of the joints.

FIG. 6 is a plan view of the ring at a joint between adjacent segments with portions of the segments broken away for clarity.

FIG. 7 is an enlarged view of two sgments of the ring in the installed condition showing the engagement between the inclined surfaces of each ring.

DESCRIPTION OF THE PREFERRED EMBODIMENT

Figure 1:
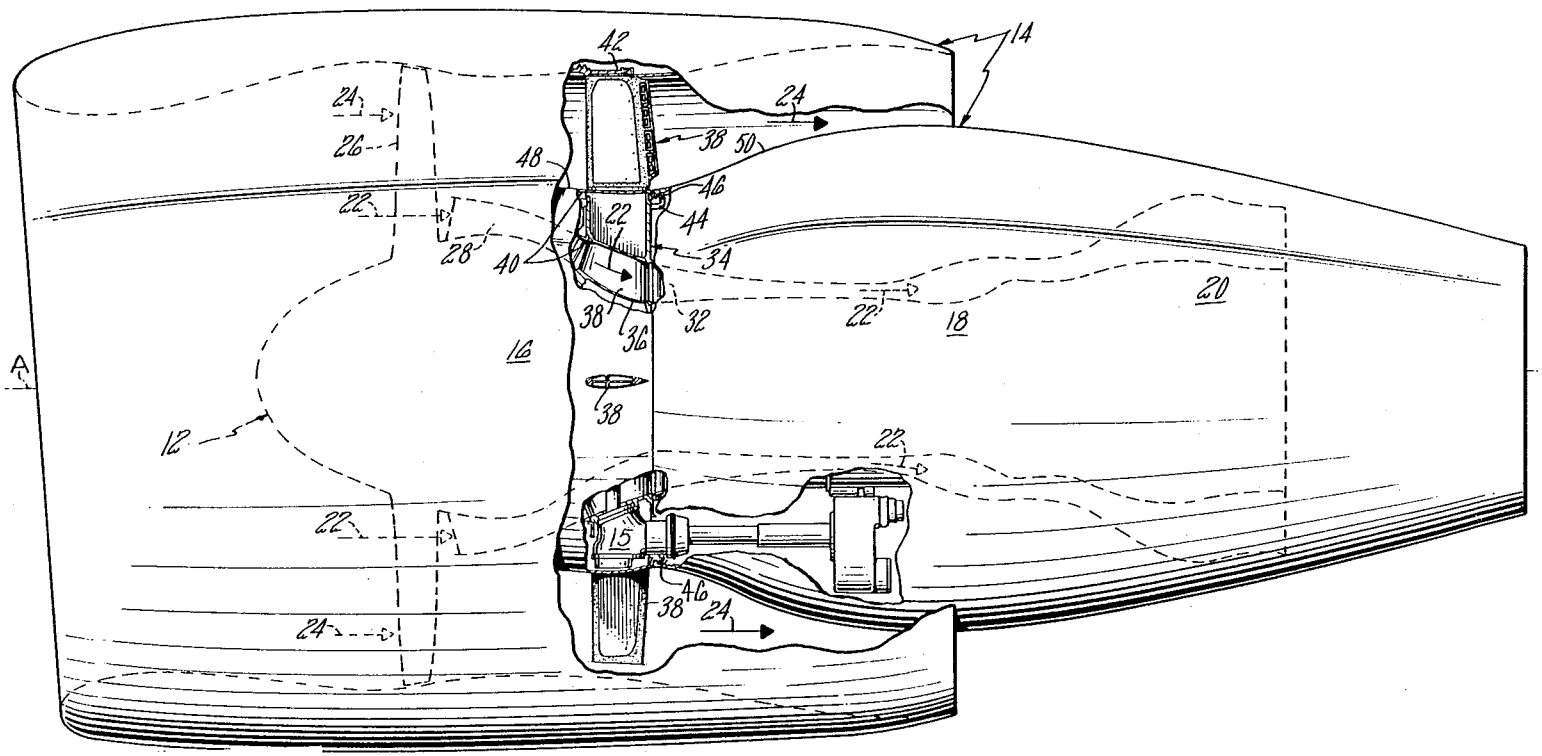
FIG. 1 is a side elevation view of a powerplant for an aircraft which includes a turbofan gas turbine engine shown schematically by dotted lines and a nacelle for the engine with the nacelle and engine broken away to show a portion of the engine.

FIG. 1 is a side elevation view of a powerplant 10 for an aircraft The powerplant includes an axial flow gas turbine engine 12 of the turbofan type (shown schematically by dotted lines) and a nacelle 14 which circumscribes the engine. The engine has an axis A. The nacelle and the exterior of the engine are broken away to show a portion of the interior of the engine and auxiliary components, as represented by the gear box 15.

The engine 12 has a compression section 16, a combustion section 18, and a turbine section 20. These sections extend circumferentially about the axis A. A primary flow path 22 for working medium gases extends circumferentially about the axis of the engine and rearwardly through the sections of the engine. A secondary flow path 24 for working medium gases, commonly called the bypass flow path, is radially outwardly of the primary flow path. The secondary flowpath extends rearwardly through the outermost portion of the compression section.

The compression section includes a fan 26, a first compressor 28 and a second compressor 32 spaced rearwardly from the first compressor. The first compressor is commonly called the low pressure compressor and the second compressor is commonly called the high pressure compressor.

A stator assembly extends axially and radially between the first compressor and the second compressor and is represented by the intermediate case 34. The intermediate case is attached to a pylon (not shown) of the aircraft and provides a support structure for the engine from the aircraft and for components of the engine within the engine.

The stator assembly includes an inner casing 36 which extends circumferentially about the axis A and inwardly of the primary flowpath 22. A plurality of struts 38 extend outwardly across the primary flow path and the secondary flow path. An outer (non-structural) casing 40 spaced radially from the inner casing extends circumferentially about the engine to engage the struts. This non-structural casing serves as an outer boundary to a portion of the primary flowpath and an inner boundary to a portion of the secondary flow path. A second outer casing spaced radially from the inner casing and outwardly of the outer casing 40, such as the fan casing 42 of an aluminum based material serves as an outer boundary to the secondary flow path.

Each strut 38 has a lug 44 spaced radially from the inner casing intermediate of the length of the strut. A seal ring assembly 46 extends circumferentially about the support structure and is disposed in each of said lugs. A liner 48 for the secondary flow path extends forwardly from the seal ring assembly to bound the secondary flow path. A nacelle wall 50 extends circumferentially about the engine and axially rearwardly from the seal ring assembly to bound the secondary flowpath in the downstream direction.

FIG. 2 is an exploded perspective view of a portion of the gas turbine engine 12 shown in FIG. 1 showing in more detail the intermediate case 34 and the seal ring assembly 46. The struts of the intermediate case is formed of cast AMS (Aerospace Material Specification) 5355 material, a precipitation hardenable steel having a thermal coefficient of expansion which is about $6.3\times10^{-6}$ inches per inch per degree Fahrenheit. The intermediate case has a first thermal expansion characteristic which is a measure of the amount of radial growth of the structure at the lug for a given increase in operative temperature of the engine. The seal ring is formed of AMS 4928, a titanium based alloy material having a thermal coefficient of expansion which is about $4.7\text{–}4.9\times10^{-6}$ inches per inch per degree Fahrenheit. The seal ring has a second thermal expansion characteristic which is a measure of the amount of radial growth of the seal ring at the lug for a given increase in operative temperature of the engine. The first thermal expansion characteristic is greater than the second thermal expansion characteristic.

The intermediate case includes two clevises 51 for attaching the intermediate case 34 to a pylon. Each clevis is attached to an associated strut.

The seal ring assembly 46 includes a seal ring 52 which is disposed in each of the lugs 44 and which extends circumferentially about the intermediate case. The seal ring has a first segment 54 which is self-supporting. The first segment is self-supporting because it has the capability of supporting its own weight. The first segment extends circumferentially about the ring to the lugs 44*a* and 44*b*. These lugs are separated by a gap G. A second segment 56 of the seal ring extends across the gap G between the lugs to engage the first segment. As will be realized, the ring might be formed of a single piece broken at one location to permit assembly over the lugs thus eliminating the need for a separate ring segment.

FIG. 3 is an enlarged cross-sectional view of a portion of the stator assembly shown in FIG. 1 showing in more detail the lug 44*c* the seal ring 52 and the adjacent nacelle wall 50. The lug has a groove extending circumferentially about the lug which adapts the lug to receive the seal ring. The groove is bounded by a first side 62 facing axially and rearwardly and a second side 64 facing the first side. A bottom surface 66 extends between the sides to radially bound the groove. The seal ring has a first slot 68 which extends circumferentially in the seal ring and faces the first side 62 of the groove. A key at each lug, as represented by the key 72, is disposed in the first slot and engages the first side of the lug to urge the seal ring against the second side 64 of the lug.

The seal ring has a circumferentially extending seal land 74 which faces outwardly. The seal land includes a first cylindrical surface 76, a V-shaped groove 78 and a second cylindrical surface 80. The flow path liner 48 slidably engages the second cylindrical surface. A plurality of bolts (not shown) which allow a limited amount of axial movement apply a radial force to the liner to urge the lines against the second cylindrical surface of the seal ring. The circumferentially extending nacelle wall 50 has a projection 82 which extends radially inward and which abuttingly engages the V-shaped groove of the seal land. The projection is capable of transmitting loads in the axial and radial direction to the seal ring. The nacelle wall has a circumferentially extending resilient seal 84 which engages the first cylindrical surface. The first cylindrical surface on the seal land is locally interrupted by an axially extending slot 86. The lug has a pin 88 which extends into the slot to form a spline type connection which acts as a locating device for the first segment of the seal ring.

FIG. 4 is a sectional view taken along the lines 4—4 of FIG. 3 showing in more detail the relationship of the key 72 to the lug 44 and to the seal ring 52. The key has a first projection 92, such as the head, and a second projection 94 which may be bent, such as the tab, to retain the key circumferentially in the lug. The key is trapped by its engagement with the lug and with the first slot 68 in the seal ring.

FIG. 5 is a view of the seal ring 52 generally taken along the direction A of FIG. 2 showing the relationship of the first segment 54 to the second segment 56. The first segment extends to the lug **44*a* (not shown) and the lug 44*b* which is show in phantom. The second segment of the seal ring extends in the gap G between these two lugs. As shown, the joint 96*b* between the adjacent segments is disposed in the groove 58 of the associated lug. Each segment of the seal ring has an inwardly facing surface 98 which engages the bottom 66** of the groove in the lug.

FIG. 6 is a plan view of one of the joints **96*a* between two segments of the ring shown in FIG. 5. Portions of the ring segments are broken away from below and a portion of the lug is broken away from above for clarity. In particular, FIG. 6 shows the relationship of the lug 44*a* to the joint 96*a* and the line of contact between adjacent segments at the joint. The first segment 54 and the second segment 56 have circumferentially extending first slots 68*a* and 68*b* which are aligned and which adapt the ring to receive the key 72**.

As shown in FIG. 6 and in FIG. 7, the first segment has an end **102*a*. The end has a radially extending slot 104, a first projection 106 extending circumferentially from the main portion of the first segment and a second projection 108 extending axially to form a hook at the end of the ring. The hook has a surface 110** facing circumferentially away from the end and inclined away from the end of the ring.

The second segment has two ends **112*a* and 112*b* as shown in FIG. 5. Each of these ends engages an associated end 102*a* (or 102*b*) of the first segment, such as the ends 102*a* or 102. FIG. 6 and FIG. 7 show the relationship of one of the ends 112*a* to an associated end 102*a*. The end 112*a* has a radially extending slot 114 with a circumferential projection 116 and an axial projection 118 that form a hook at the end. The hook has a surface 120 facing circumferentially away from the end and inclined away from the end. The surface 120 engages the surface 110 on the associated end 102*a* of the first segment. As a result, each segment exerts a tensile force $f_1$ on the adjacent segment. The key 72** urges the ring against the side of the lug with a force $F_2$ which is resisted by a force $F_2$ exerted by the side of the lug.

FIG. 7 shows the inclined surfaces 110, 120 enlarged and at a line of contact between the surfaces. The angle of inclination away from the end in the circumferential direction, that is, away from an axial reference A, is exaggerated for purposes of illustration. The actual angle of inclination is about five degrees (5°). As shown, both surfaces are also inclined from a radial reference in the circumferential direction and away from the associated end.

Figure 8:
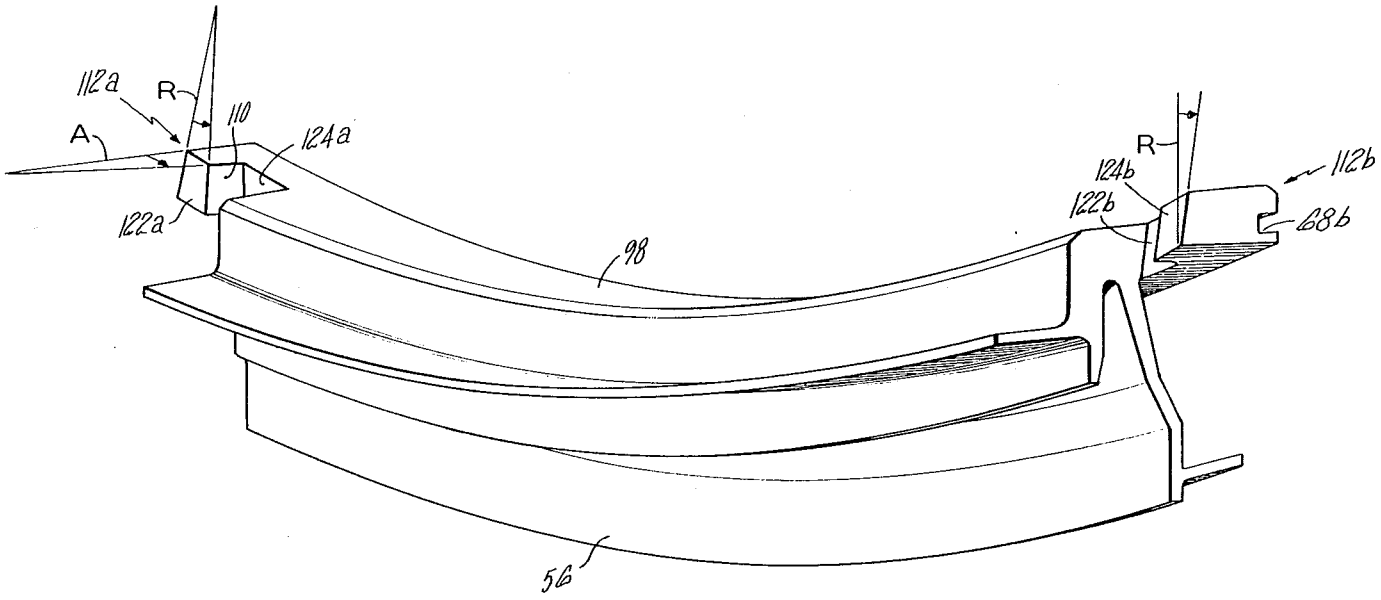
FIG. 8 is an enlarged view of one of the segments of the ring shown in FIG. 6.

FIG. 8 shows the surface 110 on the second segment 56 with this exaggerated angle of inclination in the circumferential direction away from a radial reference R. The actual angle of inclination is about five degrees (5°). The angle of inclination in the circumferential direction from the axial reference A is also shown.

FIG. 8 also shows chamfered radially facing surfaces **122*a* and 122*b* and chamfered radially facing surfaces 124*a* and 124*b***. These chamfered surfaces engage corresponding guidance surfaces (not shown) on the first segment. The chamfered surfaces on both segments act as locating surfaces to aid in aligning the seal land in the radial direction as the inclined surfaces are forced together at installation.

As each inclined surface engages the associated inclined surface and is forced into axial and radial alignment with the other segment during installation, the surfaces (and thus the ends of the segments) are slidably urged in the circumferential direction causing a displacement which stretches the ring. This stretching causes tension in the seal ring and forces the seal ring in the radial direction against the bottom 66 of the groove 58. The tension stiffens the seal ring against deflection in the axial direction and traps the ring with the key in the radial, axial and circumferential directions.

As will be realized, the inclined surfaces and the joint **96*a*** might be used with a ring having a single interruption in its circumferential continuity with a distance between the two ends that is small and does not require a second segment to bridge the distance. In such a construction, the ring is a one-piece construction having one hook as shown on the first segment and a second hook as shown on the second segment.

During installation, the seal ring 52 is expanded and installed over the integral lugs 44 to engage the grooves 58 in the lugs. The second ring segment 56 engages the first segment 54 to complete the seal ring. The segments are urged together and a retaining key is inserted at each lug. The segments are retained by the individual keys 72 at each lug including each end of each segment. As a result, the ring has full hoop continuity and therefore has a hoop loading capability. The retaining keys are multifunctional. They are used with a tight fit to position the ring and segment against the second side of the groove and yet are removable to permit disassembly of the second ring segment.

During operation of the gas turbine engine the support structure 34 and the seal ring 52 are heated. As the seal ring and stator structure increase in temperature, the difference between the first thermal expansion characteristic of the stator structure and the second thermal expansion characteristic of the ring causes the stator structure to grow radially with respect to the ring. This causes the tension in the ring to increase under operative conditions of the engine causing the hoop load forces $F_1$. The bending moment due to the hoop load force $F_1$ on each hook is resisted by the forces $F_2$ from the key and the lug. These forces $F_2$ act on the segments urging the hooks into axial engagement. The seal ring is trapped in the axial, radial and circumferential directions by the hoop load, and without the use of conventional fasteners. Accordingly, the load capacity of the lug is not adversely affected by the size and number of conventional bolt type fasteners which require an axially extending hole to fasten the seal ring.

By locating the key 72 in the lug 44, the shear load in the axial direction does not act to shear the key but acts through the full cross section of the ring 52. Because the ring is in tension, the axial stiffness of the ring is increased and local axial loads which result during flight are in part resisted by the hoop stress in the ring which exerts a restoring force on the ring. Moreover, the tensile load in the ring acts to stiffen the struts against deflections and provides a more rigid support structure by reason of the ring's engagement with the lugs on the struts.

Finally, the segmented construction permits access to auxiliary components such as the gear box 15 by removing the second segment located at the rear of the gear box. This facilitates removal of gear box components through the ring structure.

Although the invention has been shown and described with respect to detailed embodiments thereof, it should be understood by those skilled in the art that various changes in form and detail thereof may be made without departing from the spirit and the scope of the claimed invention.

We claim:

1. A stator assembly for a rotary machine which comprises a circumferentially extending structure, a plurality of struts extending radially from the structure and a self-supporting ring which engages each strut at a point intermediate of the length of the strut and which is tensioned at installation and under all normal operative conditions to stiffen the stator assembly.

2. The stator assembly of claim 1 wherein the circumferentially extending structure is an inner casing.

3. The stator assembly of claim 1 wherein the circumferentially extending structure is an inner stator structure, wherein the stator assembly further includes an outer stator structure spaced radially from and extending circumferentially about the inner stator structure, and wherein each strut has a first end attached to the inner stator structure and a second end outwardly of the self supporting ring which is attached to the outer stator structure.

4. The stator assembly of claim 3 wherein the outer stator structure is an outer casing.

5. The stator assembly of claim 3 wherein the self supporting ring is a seal ring having a seal land which adapts the ring to form a seal with an adjacent structure.

6. The stator assembly of claim 3 wherein the ring has a free length and an installed length which is greater than the free length under non-operative and operative conditions.

7. The stator assembly of claim 6 wherein said struts are formed of a material having a first thermal expansion characteristic and the ring is formed of a material having a second thermal expansion characteristic which is smaller than the first thermal expansion characteristic such that the tension in the ring is increased under operative conditions of the engine which cause an increase in the temperature of the seal ring and the support structure.

8. The stator assembly of claim 7 wherein each strut has a lug having a groove which adapts the strut to engage the ring and a side bounding the groove, wherein the ring extends circumferentially about the stator structure and exerts a radial force against the lug to trap the ring in the radial direction and wherein a means for engaging the ring exerts an axial force against the ring to urge the ring against side of the groove to trap the ring in the axial direction.

9. The stator assembly of claim 8 wherein the ring has two circumferentially facing ends, each end having a hook which adapts the end to engage the other end.

10. The stator assembly if claim 1 wherein the ring is segmented, the first segment extending circumferentially about the stator structure to a first lug and to a second lug, the second segment extending between the first and second lugs to complete the ring and to exert a circumferential force on each end of the first segment to place the ring in tension.

11. For a stator assembly of an axial flow rotary machine of the type having an axis A, an inner casing and an outer casing extending circumferentially about the axis A, the outer casing being spaced radially from the inner casing and the machine having a plurality of struts extending between the inner casing and the outer casing, the improvement which comprises:

a support structure which includes a plurality of struts extending radially from the inner casing to the outer casing, each of the struts having a lug spaced radially from the inner casing and having a groove extending circumferentially about the lug which adapts the lug to receive a seal ring, the groove being bounded by a first side, a second side and a bottom extending between the sides;

a seal ring assembly including a seal ring which extends circumferentially about the support structure, is disposed in each of said lugs, has a slot at each of said lugs extending in the circumferential direction and has a circumferentially extending seal land, the seal ring including a first segment having two ends which are spaced circumferentially leaving a gap therebetween, each end having a radially extending slot which forms a hook at the end, the hook having a surface facing circumferentially away from the end and inclined away from the end, a second segment disposed in the gap and extending circumferentially about the stator structure, the second segment having two ends which are spaced circumferentially, each end engaging an associated end of the first segment and having a radially extending slot which forms a hook at the end, the hook having a surface facing circumferentially away from the end and inclined away from the end, a key at each of said lugs which is disposed in the circumferential slot in the seal ring and which engages the first side of the lug bounding the groove to urge the seal ring against the second side of the lug bounding the groove;

wherein the associated ends of two segments are disposed in the groove of an associated lug, and the inclined surface of each end of the first segment engages the inclined surface of the associated end of the second segment and is urged slidably on said inclined surface to cause tension in the seal ring, stiffening the seal ring against deflection in the axial direction and forcing the seal ring in the radial direction against the bottom of the slot and such that the ring is trapped radially, axially and circumferentially.

12. The stator assembly of claim 11 wherein the stator structure supporting the lugs is formed of a material having a first thermal expansion characteristic the ring is formed of a material having a second thermal expansion characteristic, which is smaller than the first thermal expansion characteristic such that the tension in the ring is increased under operative conditions of the engine which cause an increase in the temperature of the seal ring and the support structure.

13. The stator assembly of claim 12 wherein the first segment of the seal ring has a locating surface which is approximately halfway between the first end and the second end, and the support structure has an associated surface which engages the first segment of the seal ring with a spline type connection which locates the ring circumferentially.

14. The stator assembly of claim 13 wherein the seal land includes an outwardly facing groove and a circumferentially extending cylindrical surface which faces outwardly and further includes a circumferentially extending duct wall having a radially inward projection which engages the outwardly facing groove and a circumferentially extending resilient seal which engages the cylindrical surface.

* * * * *